US007808464B2

(12) United States Patent
Kong

(10) Patent No.: US 7,808,464 B2
(45) Date of Patent: Oct. 5, 2010

(54) APPARATUS AND METHOD FOR DRIVING LIQUID CRYSTAL DISPLAY DEVICE

(75) Inventor: Nam Yong Kong, Seongnam-si (KR)

(73) Assignee: LG. Display Co., Ltd., Seoul (KR)

( * ) Notice: Subject to any disclaimer, the term of this patent is extended or adjusted under 35 U.S.C. 154(b) by 1134 days.

(21) Appl. No.: 11/476,976

(22) Filed: Jun. 27, 2006

(65) Prior Publication Data

US 2007/0132683 A1 Jun. 14, 2007

(30) Foreign Application Priority Data

Dec. 8, 2005 (KR) ..... 10-2005-0119558

(51) Int. Cl.
*G09G 3/36* (2006.01)

(52) U.S. Cl. ..... 345/87; 345/89; 345/204

(58) Field of Classification Search ..... 345/87–89, 345/98–100, 204, 690
See application file for complete search history.

(56) References Cited

U.S. PATENT DOCUMENTS

| | | | | |
|---|---|---|---|---|
| 6,509,930 | B1 * | 1/2003 | Hirano et al. | 348/452 |
| 6,753,929 | B1 * | 6/2004 | Sheraizin et al. | 348/586 |
| 2002/0190940 | A1 * | 12/2002 | Itoh et al. | 345/87 |
| 2005/0078069 | A1 * | 4/2005 | Aiba et al. | 345/87 |
| 2005/0080975 | A1 * | 4/2005 | Elledge et al. | 710/316 |
| 2005/0140626 | A1 * | 6/2005 | Doyen et al. | 345/89 |
| 2006/0072664 | A1 * | 4/2006 | Kwon et al. | 375/240.16 |
| 2007/0085794 | A1 * | 4/2007 | Kawabe et al. | 345/89 |

FOREIGN PATENT DOCUMENTS

| | | |
|---|---|---|
| JP | 04-213973 | 8/1992 |
| JP | 2002-006818 | 1/2002 |
| JP | 2002-082657 | 3/2002 |
| JP | 2002-191055 | 7/2002 |
| JP | 2004-177576 | 6/2004 |
| JP | 2004-233949 | 8/2004 |
| JP | 2005-148521 | 6/2005 |
| JP | 2005-196108 | 7/2005 |

OTHER PUBLICATIONS

English Translation of JP 2004-233949.*
Office Action issued in corresponding Chinese Patent Application No. 2006100903028; issued May 9, 2008.
Office Action issued in corresponding Japanese Patent Application No. 2006-176234; issued Jan. 12, 2010.

* cited by examiner

*Primary Examiner*—Amare Mengistu
*Assistant Examiner*—Hong Zhou
(74) *Attorney, Agent, or Firm*—Brinks Hofer Gilson & Lione

(57) ABSTRACT

An apparatus and method for driving an LCD device is provided. The apparatus for driving an LCD device includes an image display unit that displays an image, and a driving circuit that varies the number of frames of the image displayed in the image display unit in response to motion of the image.

13 Claims, 21 Drawing Sheets

APPARATUS AND METHOD FOR DRIVING LIQUID CRYSTAL DISPLAY DEVICE

This application claims the benefit of the Korean Patent Application No. 2005-119558, filed on Dec. 8, 2005, which is hereby incorporated by reference as if fully set forth herein.

BACKGROUND

1. Field

An apparatus and method for driving an LCD device is provided.

2. Related Art

Generally, LCDs adjust light transmittance of liquid crystal cells according to a video signal so as to display an image. An active matrix type LCD device has a switching element formed with every liquid crystal cell and is suitable for the display of a moving image. A thin film transistor (TFT) is mainly used as the switching element of the active matrix type LCD device.

FIG. 1 illustrates a related art apparatus for driving an LCD device.

Referring to FIG. 1, the related art apparatus for driving an LCD device includes an image display unit 2 including liquid crystal cells formed in each region defined by first to n-th gate lines GL1 to GLn and first to m-th data lines DL1 to DLm. A data driver 4 supplies analog video signals to the data lines DL1 to DLm. A gate driver 6 supplies scan signals to the gate lines GL1 to GLn. A timing controller 8 aligns externally input data RGB and supplies them to the data driver 4, generates data control signals DCS to control the data driver 4, and generates gate control signals GCS to control the gate driver 6.

The image display unit 2 includes a transistor array substrate, a color filter array substrate, a spacer, and a liquid crystal. The transistor array substrate and the color filter array substrate face each other and are bonded to each other. The spacer uniformly maintains a cell gap between the two substrates. The liquid crystal is filled in a liquid crystal area prepared by the spacer.

The image display unit 2 includes a TFT formed in the region defined by the gate lines GL1 to GLn and the data lines DL1 to DLm. The liquid crystal cells connect to the TFT. The TFT supplies the analog video signals from the data lines DL1 to DLm to the liquid crystal cells in response to the scan signals from the gate lines GL1 to GLn. The liquid crystal cell is comprised of common electrodes facing each other by interposing the liquid crystal therebetween and pixel electrodes connected to the TFT. Therefore, the liquid crystal cell is equivalent to a liquid crystal capacitor Clc. The liquid crystal cell includes a storage capacitor Cst connected to a previous gate line to maintain the analog video signals filled in the liquid crystal capacitor Clc until the next analog video signals are filled therein.

The timing controller 8 aligns the externally input data RGB to drive the image display unit 2 and supplies the aligned data to the data driver 4. Also, the timing controller 8 generates the data control signals DCS and the gate control signals GCS using a dot clock DCLK, a data enable signal DE, and horizontal and vertical synchronizing signals Hsync and Vsync, which are externally input, so as to control each driving timing of the data driver 4 and the gate driver 6.

The gate driver 6 includes a shift register that sequentially generates scan signals, for example, gate high signals in response to a gate start pulse (GSP) and a gate shift clock (GSC) are among the gate control signals GCS from the timing controller 8. The gate driver 6 sequentially supplies the gate high signals to the gate lines GL of the image display unit 2 to turn on the TFT connected to the gate lines GL.

The data driver 4 converts the data signals Data aligned from the timing controller 8 into the analog video signals in response to the data control signals DCS supplied from the timing controller 8. The data driver supplies the analog video signals corresponding to one horizontal line per one horizontal period in which the scan signals are supplied into the gate lines GL to the data lines DL. In other words, the data driver 4 selects a gamma voltage having a predetermined level depending on a gray level value of the data signals Data and supplies the selected gamma voltage to the data lines DL1 to DLm. At this time, the data driver 4 inverses polarity of the analog video signals supplied to the data lines DL in response to a polarity control signal POL.

The related art apparatus for driving an LCD device has a relatively slow response speed due to characteristics such as the inherent viscosity and elasticity of the liquid crystal. In other words, although the response speed of the liquid crystal may be different according to the physical properties and cell gap of the liquid crystal, it is common that the rising time is in the range of 20 ms to 80 ms and the falling time is in the range of 20 to 30 ms. Because this response speed is longer than one frame period (16.67 ms in National Television Standards Committee (NTSC)) of a moving image, as shown in FIG. 2, the response of the liquid crystal proceeds to the next frame before the voltage being charged on the liquid crystal cell reaches a desired level.

Since the image of each frame displayed in the image display unit 2 affects the image of the next frame, motion blurring occurs in the moving image due to perception of a viewer.

In the related art apparatus and method for driving an LCD device, motion blurring causes degradation in contrast ratio, and, in turn, degradation in display quality.

In order to prevent motion blurring from occurring, an over-driving apparatus has been suggested that modulates a data signal to obtain the fast response speed of the liquid crystal.

FIG. 3 is a block diagram illustrating a related art over-driving apparatus.

Referring to FIG. 3, the related art over-driving apparatus 50 includes a frame memory 52 that stores RGB data of a current frame Fn. A look-up table 54 generates modulated data that obtains the fast response speed of the liquid crystal by comparing the data RGB of the current frame Fn with data of a previous frame Fn-1 stored in the frame memory 52. A mixing unit 56 mixes the modulated data from the look-up table 54 with the data RGB of the current frame Fn.

The look-up table 54 lists modulated data R'G'B' that converts a voltage of the data RGB of the current frame Fn into a higher voltage to obtain the fast response speed of the liquid crystal, thereby adapting to a gray level value of an image moving at the fast speed.

In the aforementioned related art over-driving apparatus 50, since a voltage higher than an actual data voltage is applied to the liquid crystal using the look-up table 54 as shown in FIG. 4, the fast response speed of the liquid crystal is adapted to a target gray level voltage until a desired gray level value is actually obtained.

The related art over-driving apparatus 50 can reduce motion blurring of a display image by accelerating the response speed of the liquid crystal using the modulated data R'G'B'.

A problem occurs in that the related art because the LCD device fails to obtain a clear image due to motion blurring occurring in boundaries A and B of each image, as shown in FIG. 5, even though the image is displayed using the over-driving apparatus. In other words, since luminance increases between the boundaries A and B of the image to have a tilt, motion blurring still occurs even though the liquid crystal is driven at a high speed.

If the display image is driven in a frame frequency of 120 Hz, the related art LCD device can reduce motion blurring of the display image. However, there may exist various problems relating to the charge and discharge of the image display unit, a thermal problem of a driver, electromagnetic interference (EMI) caused by high frequency, and difficulty in a circuit design.

SUMMARY

An apparatus and method for driving an LCD device is provided.

An apparatus that drives an LCD device includes an image display unit that displays an image. A driving circuit varies the number of frames of the image displayed in the image display unit in response to motion of the image.

The driving circuit includes a data driver that supplies video signals to the image display unit. A gate driver supplies scan signals to the image display unit. A frame varying unit generates modulated data and a frame variable signal that varies the number of frames of the image displayed in the image display unit by detecting a motion vector from externally input source data. A timing controller aligns the modulated data and supplies the aligned data to the data driver, generates data control signals that drive the data driver, and generates gate control signals to drive the gate driver.

A method for driving an LCD device having an image display unit that displays an image. The method includes detecting a motion vector from externally input source data of the image, and varying the number of frames of the image displayed in the image display unit in response to the motion vector.

The act of varying the number of frames of the image includes generating modulated data and a frame variable signal that varyies the number of frames of the image displayed in the image display unit in response to the motion vector, generating the modulated data to obtain the number of frames corresponding to the frame variable signal, generating a frame synchronizing signal by varying an externally input reference frame synchronizing signal in response to the frame variable signal to correspond to the number of frames, generating data and gate control signals using the frame synchronizing signal, supplying scan signals to the image display unit using the gate control signals, and converting the modulated data into analog video signals using the data control signals and supplying the analog video signals to the image display unit to synchronize with the scan signals.

It is to be understood that both the foregoing general description and the following detailed description are exemplary and explanatory and are intended to provide further explanation of the invention as claimed.

DRAWINGS

The accompanying drawings, which are included to provide a further understanding of the embodiments and illustrate the embodiment(s). In the drawings.

DESCRIPTION

Reference will now be made in detail to the preferred embodiments, examples are illustrated in the accompanying drawings. Wherever possible, the same reference numbers will be used throughout the drawings to refer to the same or like parts.

Figure 1:
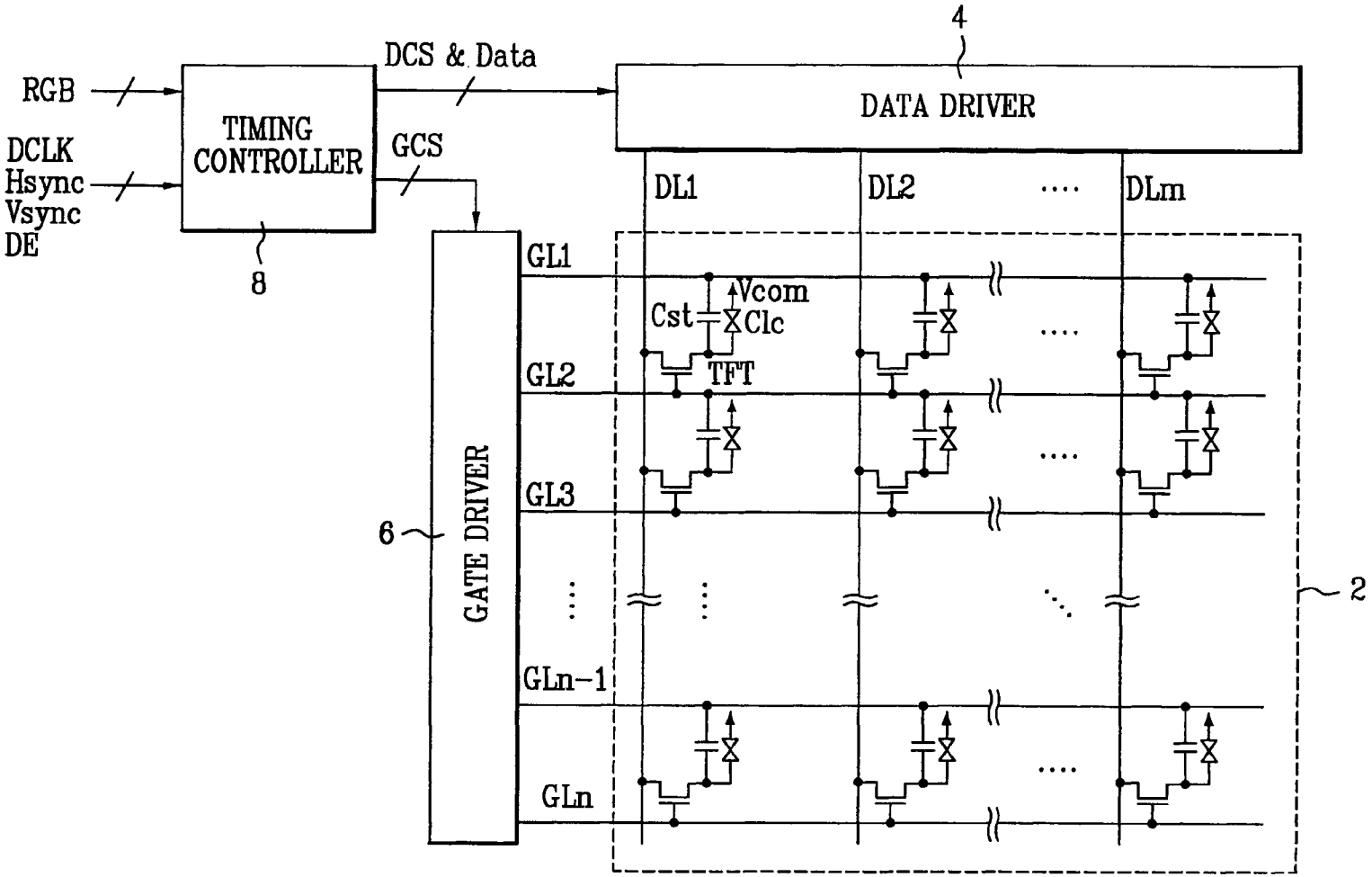
FIG. 1 Related Art
FIG. 1 illustrates a related art apparatus for driving an LCD device.
Figure 2:
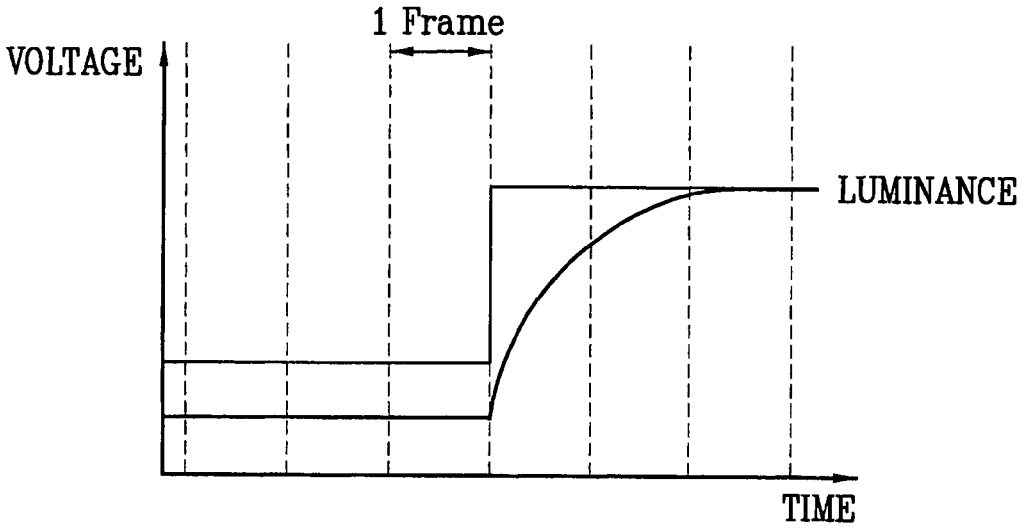
FIG. 2 Related Art
FIG. 2 illustrates the response speed and luminance of a liquid crystal cell shown in FIG. 1.
Figure 3:
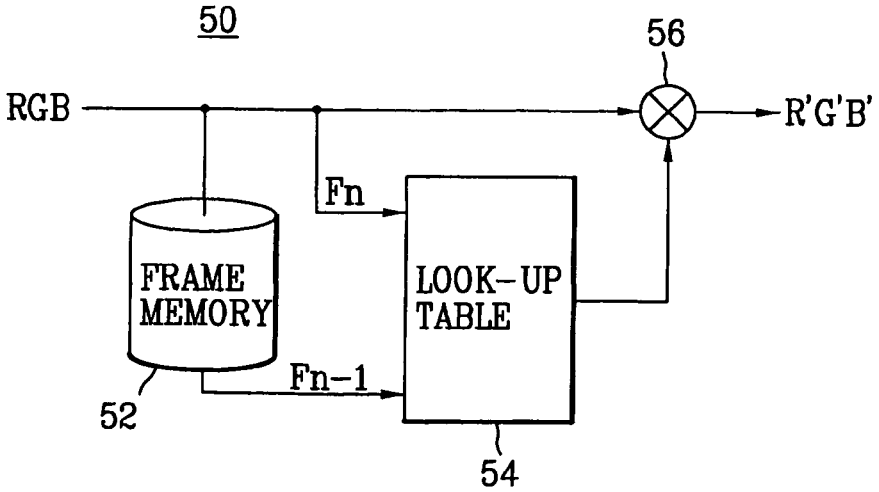
FIG. 3 Related Art
FIG. 3 is a block diagram illustrating a related art over-driving apparatus.
Figure 4:
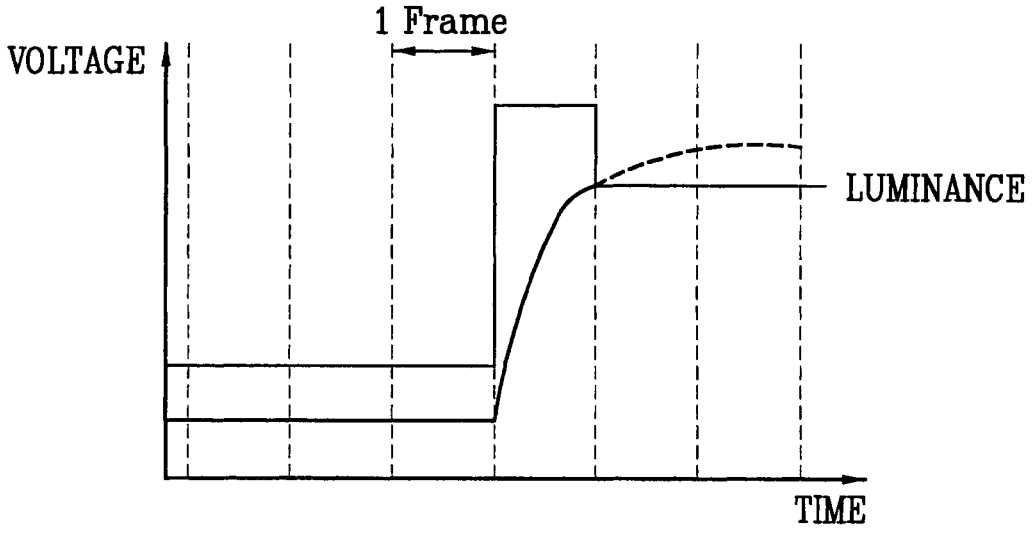
FIG. 4 Related Art
FIG. 4 illustrates the response speed and luminance of a liquid crystal cell in a related art over-driving apparatus shown in FIG. 3.
Figure 5:
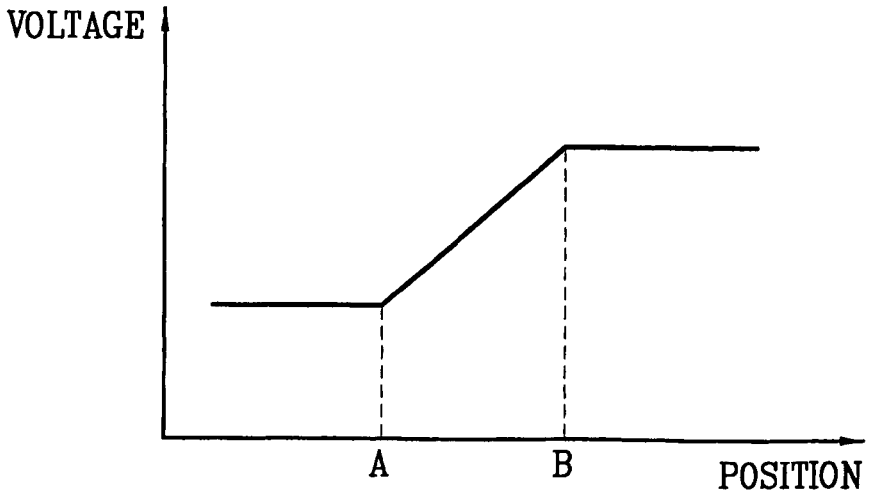
FIG. 5 Related Art
FIG. 5 illustrates boundaries of an image according to the related art.
Figure 6:
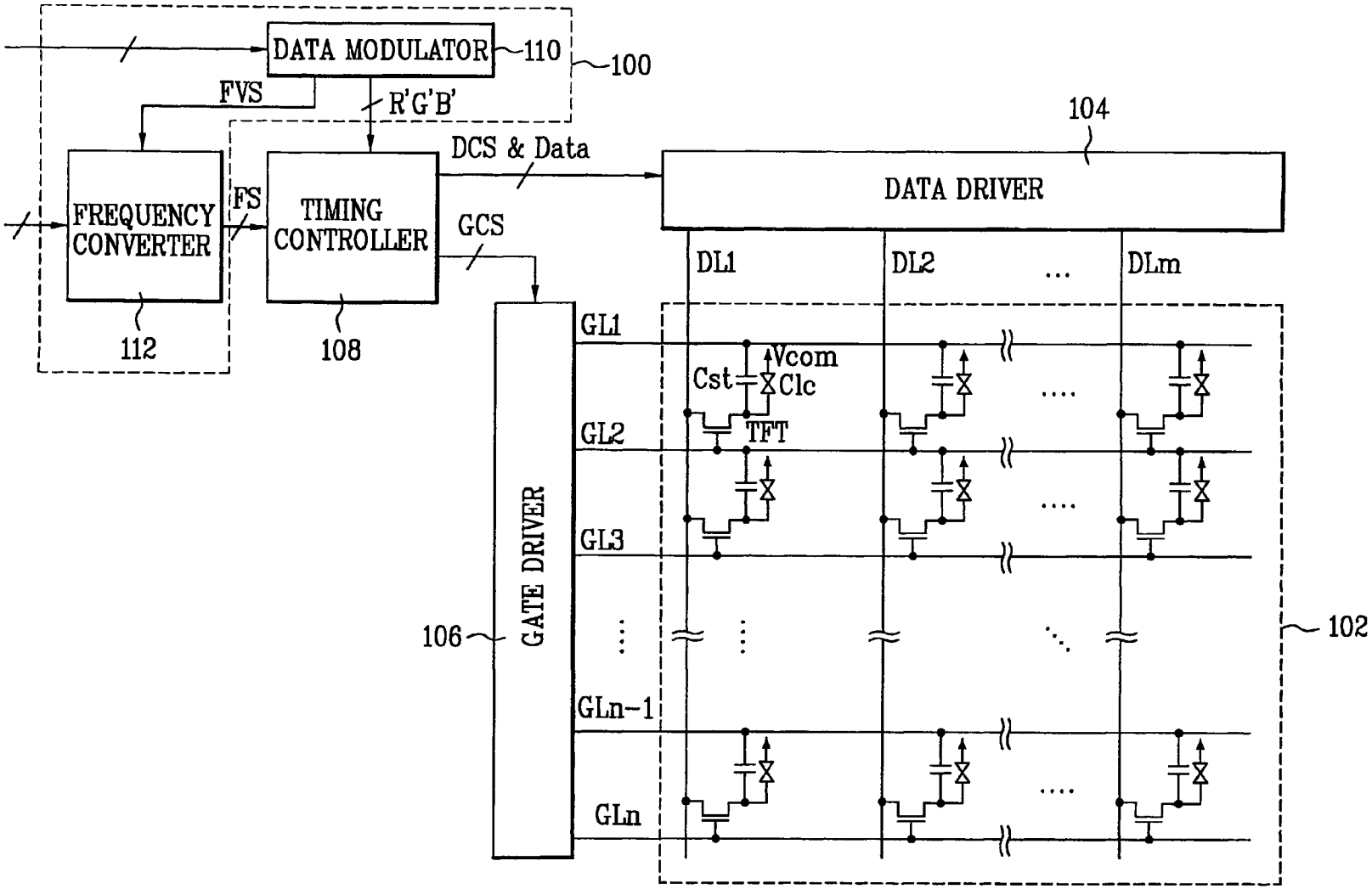
FIG. 6 illustrates an apparatus for driving an LCD device according to a first embodiment.

FIG. 6 illustrates an apparatus for driving an LCD device according to the first embodiment.

Referring to FIG. 6, the apparatus that drives an LCD device according to the first embodiment includes an image display unit 102 that includes liquid crystal cells formed in each region defined by first to n-th gate lines GL1 to GLn and first to m-th data lines DL1 to DLm. A driving circuit unit detects a motion vector from externally input source data RGB and generates modulated data R'G'B' and a frame variable signal FVS that varies the number of frames displayed in the image display unit 102 in response to the motion vector.

The image display unit 102 includes a transistor array substrate, a color filter array substrate, a spacer, and a liquid crystal. The transistor array substrate and the color filter array substrate face each other and are bonded to each other. The spacer uniformly maintains a cell gap between the two substrates. The liquid crystal is filled in a liquid crystal area prepared by the spacer.

The image display unit 102 includes a TFT formed in the region defined by the gate lines GL1 to GLn and the data lines DL1 to DLm, and the liquid crystal cells connects to the TFT. The TFT supplies the analog video signals from the data lines DL1 to DLm to the liquid crystal cells in response to the scan pulses from the gate lines GL1 to GLn. The liquid crystal cell is comprised of common electrodes that face each other by interposing the liquid crystal therebetween and pixel electrodes connect to the TFT. Therefore, the liquid crystal cell is equivalent to a liquid crystal capacitor Clc. The liquid crystal cell includes a storage capacitor Cst connected to a previous gate line to maintain the analog video signals filled in the liquid crystal capacitor Clc until the next analog video signals are filled therein.

The driving circuit unit includes a data driver 104 that supplies analog video signals to the data lines DL1 to DLm. A gate driver 106 supplies scan signals to the gate lines GL1 to GLn. A frame varying unit 100 detects a motion vector from source data RGB and generates modulated data R'G'B' and a frame variable signal FVS that varyies the number of frames of an image displayed in the image display unit 102. A timing controller 108 aligns the modulated data R'G'B' from the frame varying unit 100 and supplies the aligned data to the data driver 104, generates data control signals DCS that drive the data driver 104, and generates gate control signals GCS that drives the gate driver 106.

The frame varying unit 100 includes a data modulator 110 and a frequency converter 112.

The data modulator 110 detects the motion vector from luminance components of the externally input source data RGB, and generates the frame variable signal FVS in response to the detected motion vector. The data converter 110 generates modulated data R'G'B' by modulating the luminance components of the source data RGB to obtain the number of frames corresponding to the frame variable signal FVS, and supplies the generated modulated data R'G'B' to the timing controller 108.

The frequency converter 112 generates a frame synchronizing signal FS by varying an externally input reference frame synchronizing signal FS1 in response to the frame variable signal FVS from the data modulator 110, and supplies the generated frame synchronizing signal FS to the timing controller 108.

The frame varying unit 100, which includes the data modulator 110 and the frequency converter 112, may be provided inside the timing controller 108.

Figure 7:
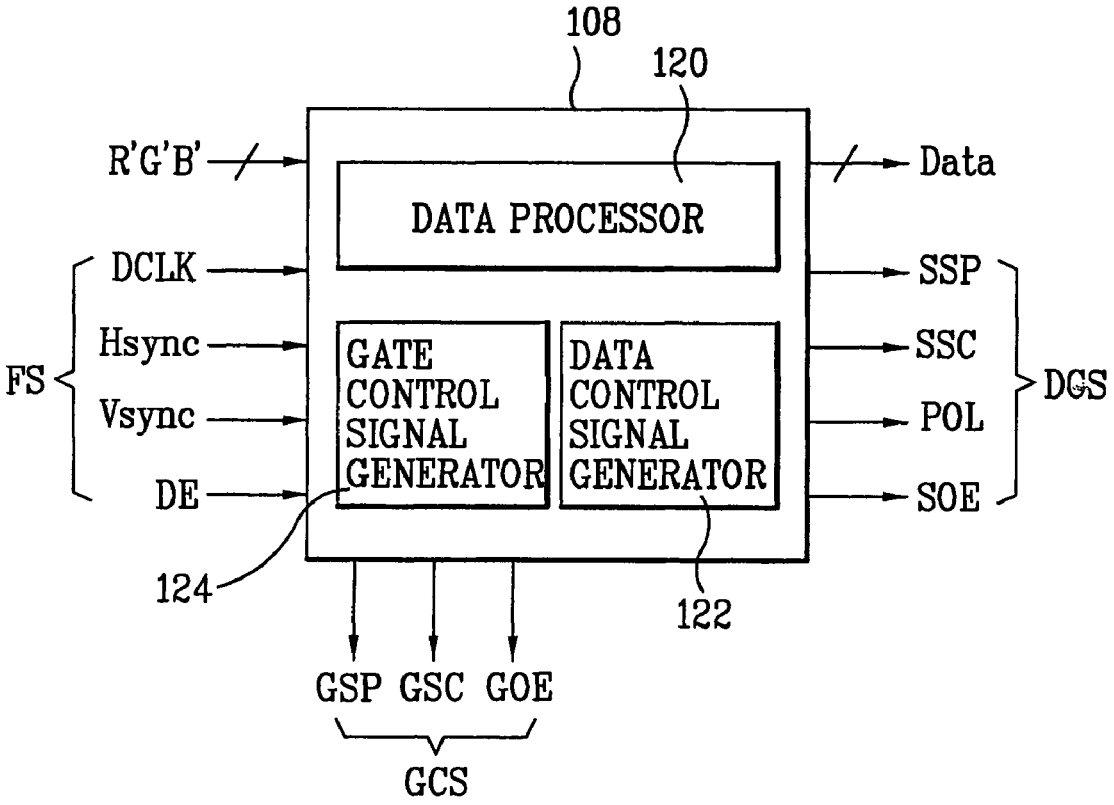
FIG. 7 is a block diagram that illustrates a timing controller shown in FIG. 6.

The timing controller 108, as shown in FIG. 7, includes a data processor 120, a data control signal generator 122, and a gate control signal generator 124.

The data processor 120 aligns the modulated data R'G'B' supplied from the data modulator 110 to a data signal Data that drives the image display unit 102, and supplies the aligned data signal Data to the data driver 104.

The data control signal generator 122 generates the data control signals DCS, which include a source start pulse SSP, a source shift clock SSC, a polarity signal POL, and a source output enable signal SOE, using the frame synchronizing signal FS input from the frequency converter 112. The frame synchronizing signal FS may be a main clock MCLK, a data enable signal DE, and horizontal and vertical synchronizing signals Hsync and Vsync.

The gate control signal generator 124 generates the gate control signals GCS, which include, for example, a gate start pulse GSP, a gate shift clock GSC, and a gate output enable signal GOE, using the frame synchronizing signal FS, and supplies the generated gate control signals GCS to the gate driver 106.

The gate driver 106 includes a shift register that sequentially generates scan signals, for example, gate high signals in response to the gate control signals GCS from the timing controller 108. The gate driver 106 sequentially supplies the gate high signals to the gate lines GL of the image display unit 102 to turn on the TFT connected to the gate lines GL.

The data driver 104 converts the data signal Data aligned from the timing controller 108 into the analog video signals in response to the data control signals DCS supplied from the timing controller 108, and supplies to the data lines DL the analog video signals corresponding to one horizontal line per one horizontal period in which the scan signals are supplied to the gate lines GL. The data driver 104 generates the analog video signals by selecting a gamma voltage having a predetermined level depending on a gray level value of the data signal Data, and supplies the generated analog video signals to the data lines DL1 to DLm. The data driver 104 inverses polarity of the analog video signals supplied to the data lines DL in response to a polarity control signal POL.

According to the first embodiment, it is possible to remove motion blurring of a moving image by detecting the motion vector from the input data RGB, generating the frame variable signal FVS in response to the detected motion vector, and varying the number of frames of the image displayed in the image display unit 102 in response to the generated frame variable signal FVS.

Figure 8:
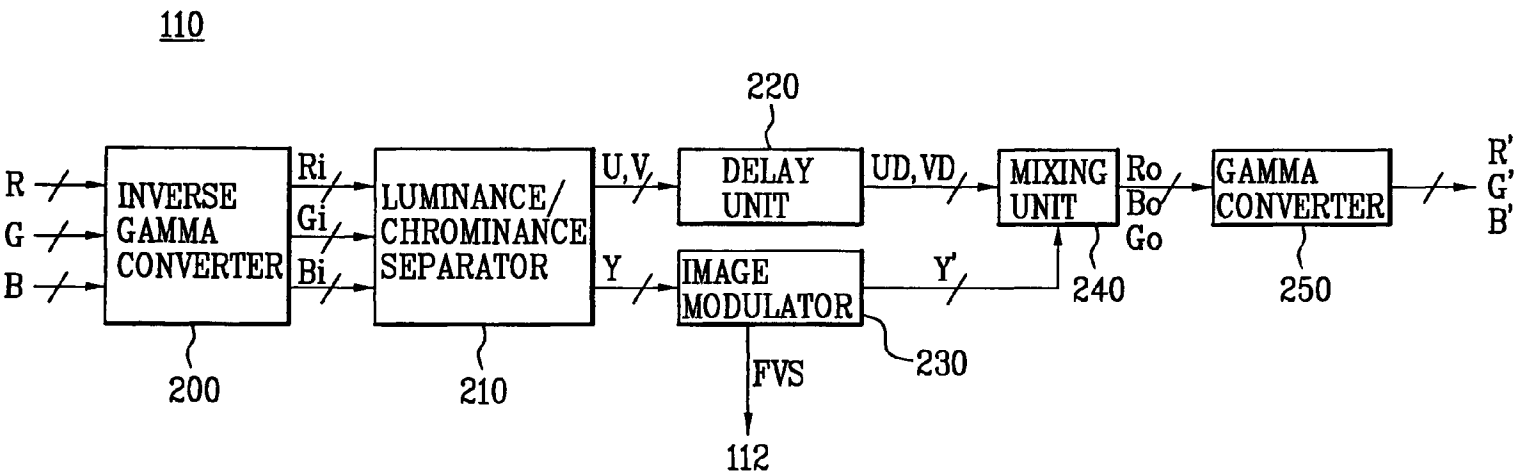
FIG. 8 is a block diagram that illustrates a data modulator shown in FIG. 6 in accordance with the first embodiment.

FIG. 8 is a block diagram that illustrates the data modulator 110 shown in FIG. 6 in accordance with the first embodiment.

Referring to FIG. 8 in connection with FIG. 6, the data modulator 110 includes an inverse gamma converter 200, a luminance/chrominance separator 210, a delay unit 220, an image modulator 230, a mixing unit 240, and a gamma converter 250.

The inverse gamma converter 200 converts the externally input source data RGB into first linear data Ri, Gi and Bi using the following equation (1) because the externally input data RGB has undergone gamma correction considering output characteristics of a cathode ray tube.

$$Ri=R^{\lambda}$$

$$Gi=G^{\lambda}$$

$$Bi=B^{\lambda} \quad (1)$$

The luminance/chrominance separator 210 separates the first data Ri, Gi and Bi of a frame unit into a luminance component Y and chrominance components U and V. The luminance component Y and the chrominance components U and V are respectively obtained by the following equations (2) to (4).

$$Y=0.229\times Ri+0.587\times Gi+0.114\times Bi \quad (2)$$

$$U=0.493\times(Bi-Y) \quad (3)$$

$$V=0.887\times(Ri-Y) \quad (4)$$

The luminance/chrominance separator 210 supplies the luminance component Y separated from the first data Ri, Gi and Bi by the equations (2) to (4) to the image modulator 230 and also supplies the chrominance components U and V separated from the first data Ri, Gi and Bi to the delay unit 220.

The image modulator 230 according to the first embodiment detects the motion vector using the luminance component Y from the luminance/chrominance separator 210, and generates the frame variable signal FVS using the detected motion vector. The image modulator 230 generates a luminance component Y' to obtain the number of frames corresponding to the frame variable signal FVS and supplies the luminance component Y' to the mixing unit 240.

Figure 9:
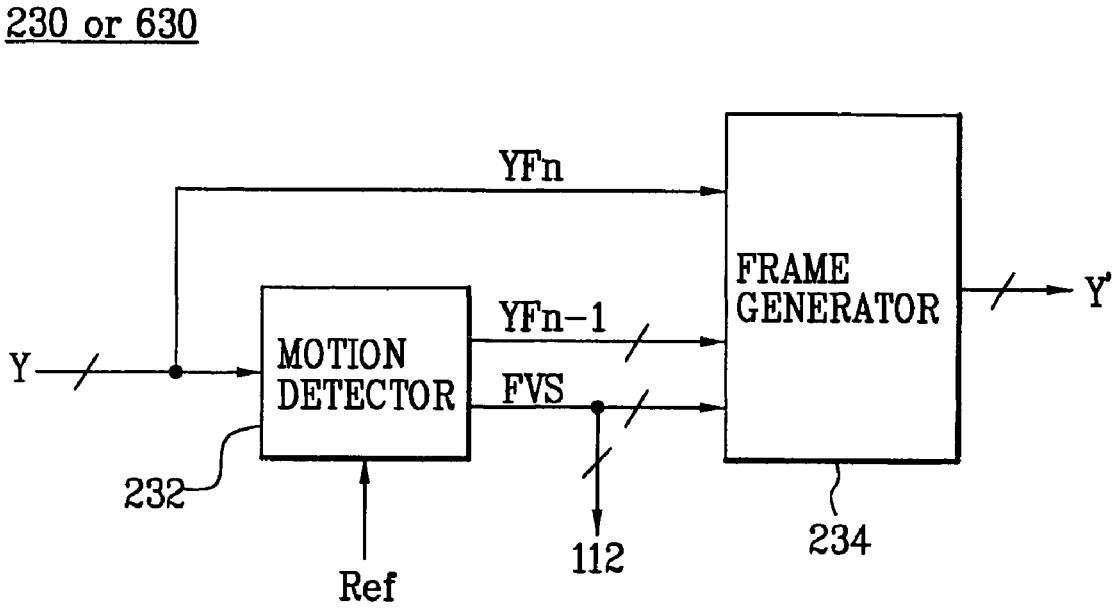
FIG. 9 is a block diagram that illustrates an image modulator shown in FIG. 8 in accordance with the first and third embodiments.

The image modulator 230, as shown in FIG. 9, includes a motion detector 232 and a frame generator 234.

Figure 10:
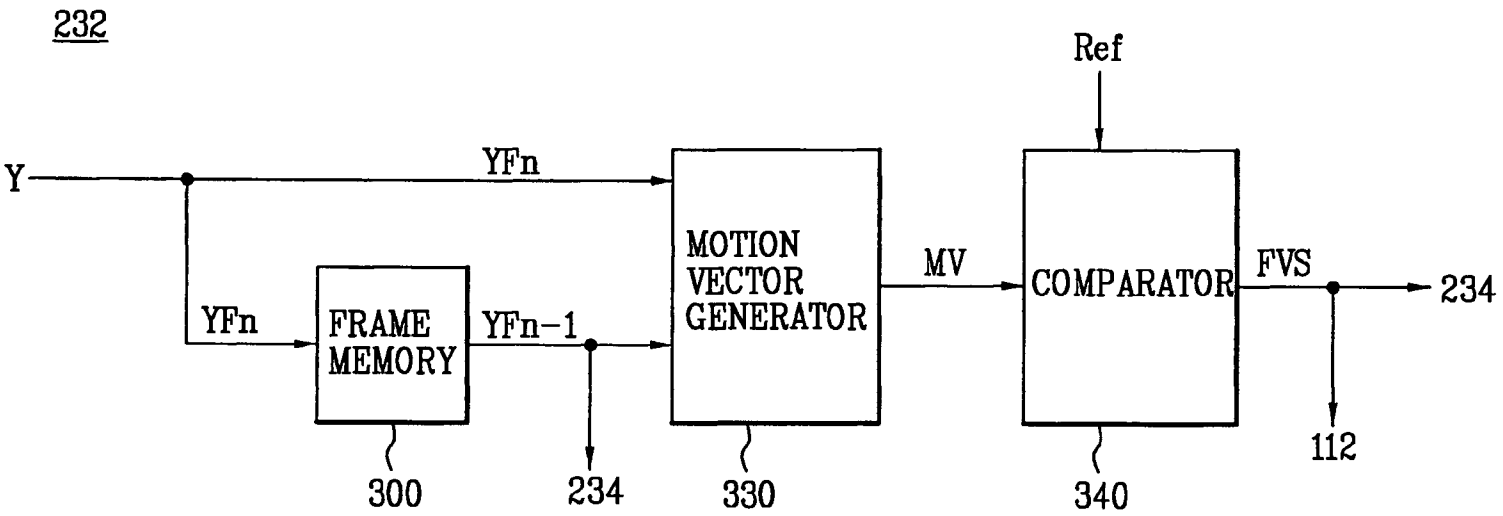
FIG. 10 is a block diagram that illustrates a motion detector shown in FIG. 9.

The frame detector 232, as shown in FIG. 10, includes a frame memory 300, a motion vector generator 330, and a comparator 340.

The frame memory 300 stores the luminance component Y supplied from the luminance/chrominance separator 210 for each unit of frame. The luminance component Y stored in the frame memory 300 for each unit of frame is supplied to the motion vector generator 330 and the frame generator 234.

The motion vector generator 330 generates a motion vector MV using a luminance component YFn of a current frame supplied from the luminance/chrominance separator 210 and a luminance component YFn-1 of a previous frame supplied from the frame memory 300.

Specifically, the motion vector generator 330 detects a point equal to average luminance of a block unit of i×i by comparing the luminance component of the current frame Fn with the luminance component of the previous frame Fn-1, so as to generate the motion vector MV corresponding to motion speed from the distance between a current pixel and a similar pixel.

The comparator 340 generates a frame variable signal FVS having a logic state of a 2-bit signal by comparing the motion vector MV supplied from the motion vector generator 330 with a plurality of reference values. Supposing that the size of the maximum motion vector MV for a block unit of i×i is 10 in case of the image moving for a unit of 10 pixel/frame, the reference values are sent as a first reference value Ref1 having a value of '2' and a second reference value Ref2 having a value of '5'. The reference values may be reset as other values by a user.

The comparator 340 generates a frame variable signal FVS having a first logic state if the motion vector MV is smaller than the first reference value Ref1, and generates a frame variable signal FVS of a second logic state if the motion vector MV is between the first and second reference values Ref1 and Ref2. The comparator 340 generates a frame variable signal FVS of a third logic state if the motion vector MV is greater than the second reference value Ref2. The frame variable signal FVS inlcudes any one of the first to third logic states, generated by the comparator 340 that are supplied to the frame generator 234 and the frequency converter 112, respectively.

Figure 11:
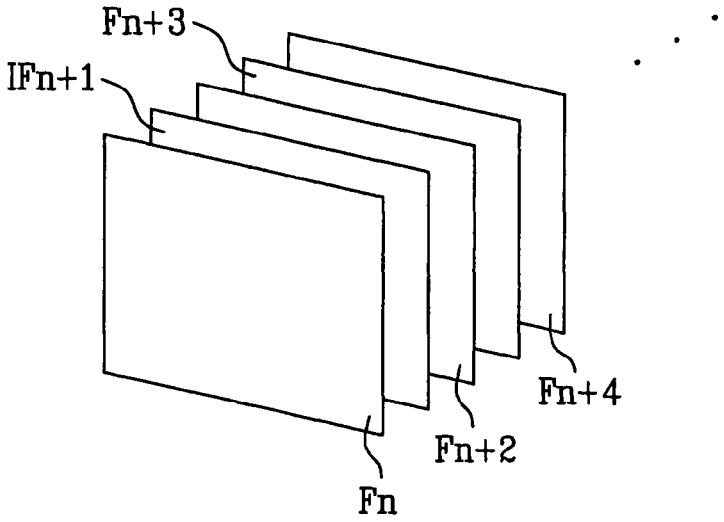
FIG. 11 illustrates the order of modulated data having a frame frequency of 60 Hz generated by a frame generator shown in FIG. 9.

If the frame variable signal FVS of the first logic state is supplied from the motion detector 232, the frame generator 234 shown in FIG. 9 bypasses the luminance component YFn of the current frame that is supplied from the luminance/chrominance separator 210 as shown in FIG. 11 and then supplies it to the mixing unit 240. For example, the luminance component Y' supplied from the frame generator 234 to the mixing unit 240 in response to the frame variable signal FVS of the first logic state has the frame frequency of 60 Hz.

If the frame variable signal FVS of the second logic state is supplied from the motion detector 232, the frame generator 234 generates a luminance component of a reference frame by comparing the luminance component YFn of the current frame supplied from the luminance/chrominance separator 210 with the luminance component YFn-1 of the previous frame that is supplied from the frame memory 300, and generates a luminance component of an insertion frame by comparing the luminance component of the reference frame with the luminance component YFn of the current frame. The frame generator 234 generates the reference frame as an intermediate luminance component by comparing the luminance component of the previous frame with the luminance component of the current frame for each unit of block, and generates the insertion frame as the intermediate luminance component by comparing the luminance component of the reference frame with the luminance component of the current frame for each unit of block.

Figure 12:
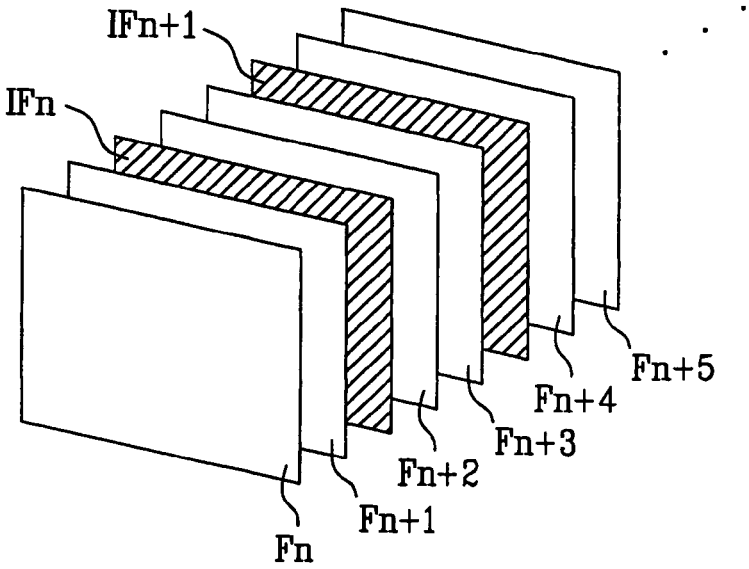
FIG. 12 illustrates the order of modulated data having a frame frequency of 90 Hz generated by a frame generator shown in FIG. 9.

The frame generator 234, as shown in FIG. 12, supplies the luminance component Y' of a frame unit to the mixing unit 240 in the order of the previous frame Fn-1, the current frame Fn and the insertion frame IFn in response to the frame variable signal FVS of the second logic state. In other words, the frame generator 234 supplies the luminance component of frame 3 to the mixing unit 240 using the luminance component of frame 2. For example, the luminance component Y' supplied from the frame generator 234 to the mixing unit 240 in response to the frame variable signal FVS of the second logic state has a frame frequency of 90 Hz.

Figure 13:
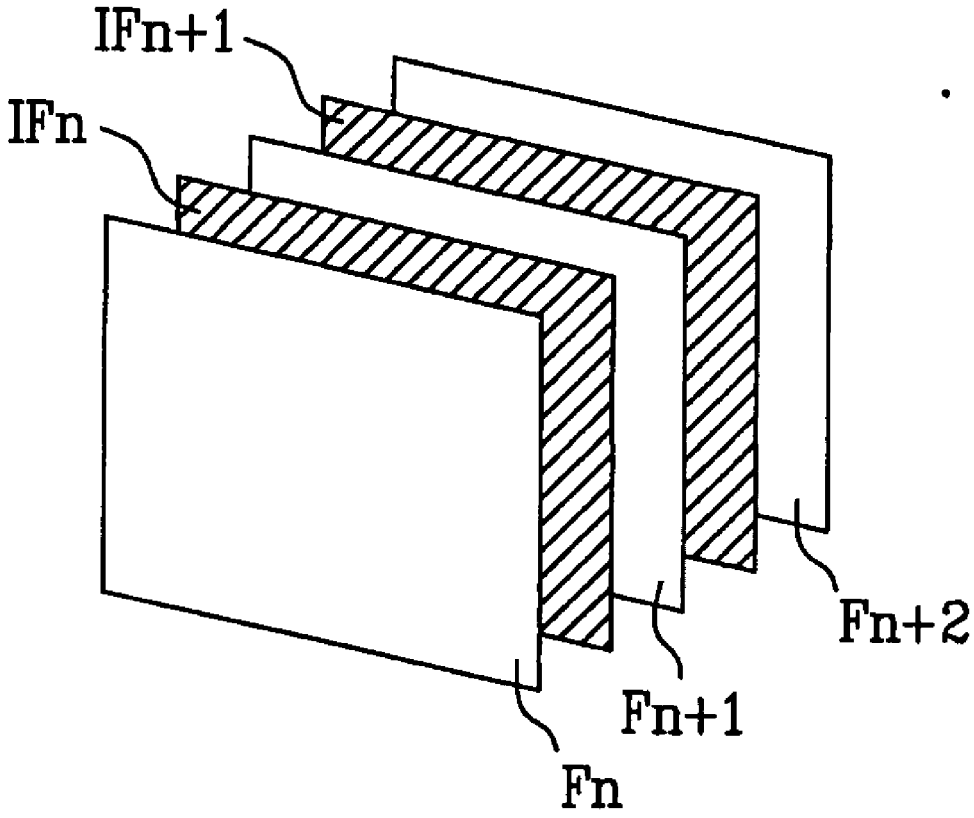
FIG. 13 illustrates the order of modulated data having a frame frequency of 120 Hz generated by a frame generator shown in FIG. 9.

If the frame variable signal FVS of the third logic state is supplied from the motion detector 232, the frame generator 234 generates the luminance component of the insertion frame by comparing the luminance component YFn of the current frame supplied from the luminance/chrominance separator 210 with the luminance component YFn-1 of the previous frame supplied from the frame memory 300. The frame generator 234 generates the insertion frame as the intermediate luminance component by comparing the luminance component of the previous frame with the luminance component of the current frame for each unit of block. Such a frame generator 234, as shown in FIG. 13, supplies the luminance component Y of the insertion frame to the mixing unit 240 by inserting the luminance component Y of the insertion frame between the previous frame Fn-1 and the current frame Fn. For example, the luminance component Y' supplied from the frame generator 234 to the mixing unit 240 in response to the frame variable signal FVS of the third logic state has a frame frequency of 120 Hz.

The delay unit 220 shown in FIG. 8 generates delayed chrominance components UD and VD by delaying the chrominance components U and V of a frame unit while the image modulator 230 varies the number of frames in response to the frame variable signal FVS. The delay unit 220 supplies to the mixing unit 240 the delayed chrominance components UD and VD to synchronize with the modulated luminance component Y'.

The mixing unit 240 generates second data Ro, Go and Bo by mixing the modulated luminance component Y' supplied from the image modulator 230 with the chrominance components UD and VD supplied from the delay unit 220. The second data Ro, Go and Bo are obtained by the following equations (5) to (7).

$$Ro=Y'+0.000\times UD+1.140\times VD \quad (5)$$

$$Go=Y'-0.396\times UD-0.581\times VD \quad (6)$$

$$Bo=Y'+2.029\times UD+0.000\times VD \quad (7)$$

The gamma converter 250 performs gamma correction for the second data Ro, Go and Bo supplied from the mixing unit 240 using the following equation (8) to generate modulated data R'G'B'.

$$R'=(Ro)^{1/\lambda}$$

$$G'=(Go)^{1/\lambda}$$

$$B'=(Bo)^{1/\lambda} \quad (8)$$

The gamma converter 250 performs gamma correction for the second data Ro, Go and Bo to the modulated data R'G'B' suitable for the driving circuit of the image display unit 102 using a look-up table, and supplies the resultant data to the timing controller 108.

Figure 14:
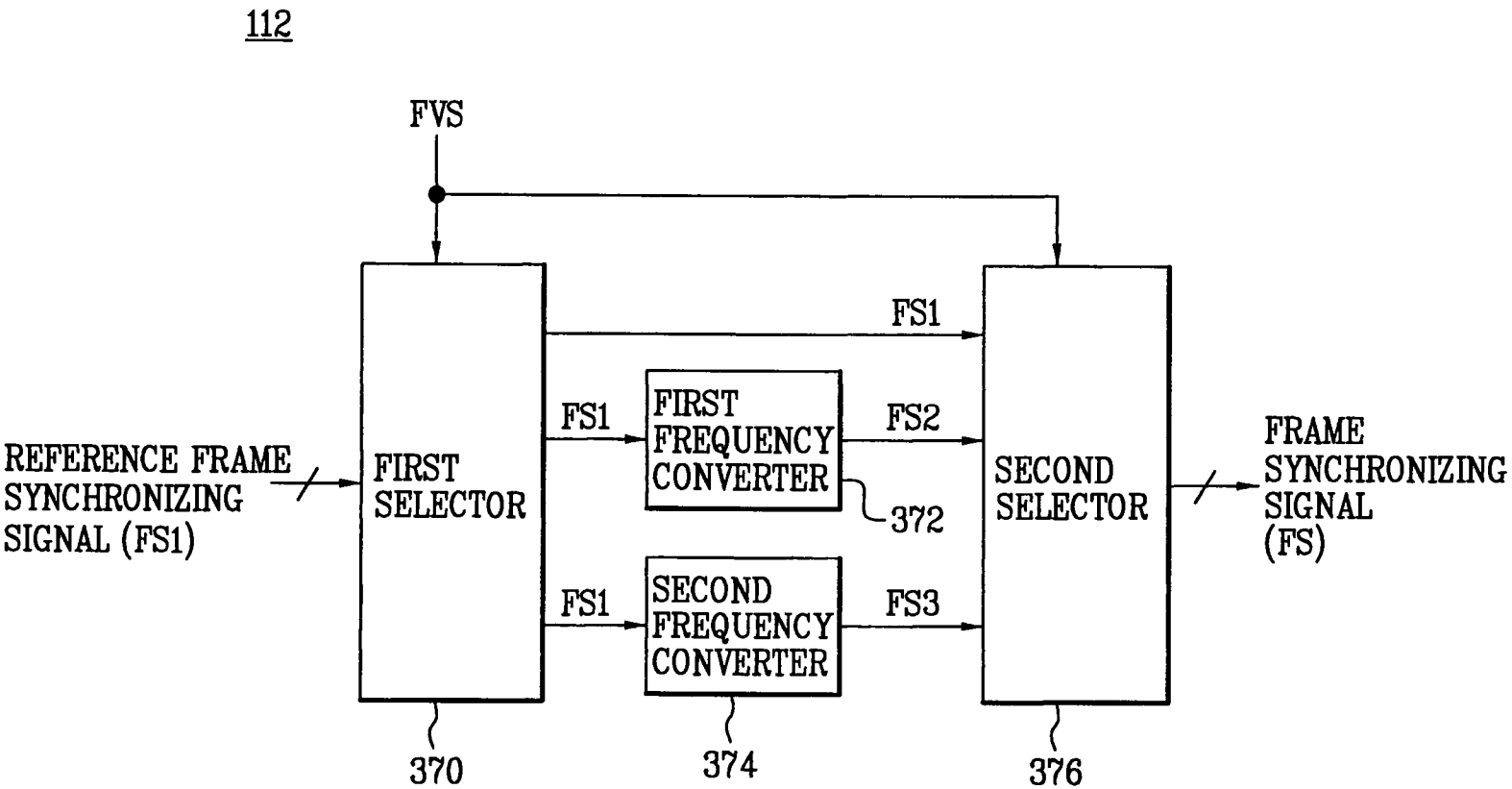
FIG. 14 is a block diagram that illustrates a frequency converter shown in FIG. 6.

FIG. 14 is a block diagram that illustrates a frequency converter shown in FIG. 6.

Referring to FIG. 14 in connection with FIG. 6, the frequency converter 112 includes a first selector 370, a first frequency converter 372, a second frequency converter 374, and a second selector 376.

The first selector 370 supplies the externally supplied reference frame synchronizing signal FS1 to any one of the second selector 376, the first frequency converter 372, and the second frequency converter 374 in response to the frame variable signal FVS from the data modulator 110. The first selector 370 may be a demultiplexer DEMUX. The reference frame synchronizing signal FS1 may have a frequency of 60 Hz. The reference frame synchronizing signal FS1 selected by the first selector 370 will be referred to as a first frame synchronizing signal FS1.

In other words, the first selector 370 supplies the first frame synchronizing signal FS1 to the second selector 376 in response to the frame variable signal FVS of the first logic state, and supplies the first frame synchronizing signal FS1 to the first frequency converter 372 in response to the frame variable signal FVS of the second logic state. The first selector 370 supplies the first frame synchronizing signal FS1 to the second frequency converter 374 in response to the frame variable signal FVS of the third logic state.

The first frequency converter 372 converts the first frame synchronizing signal FS1 supplied from the first selector 370 into a second frame synchronizing signal FS2 and supplies the second frame synchronizing signal FS2 to the second selector 376. The second frame synchronizing signal FS2 may have a frequency of 90 Hz.

The second frequency converter 374 converts the first frame synchronizing signal FS1 supplied from the first selector 370 into a third frame synchronizing signal FS3 and supplies the third frame synchronizing signal FS3 to the second selector 376. The third frame synchronizing signal FS3 may have a frequency of 120 Hz.

The second selector 376 supplies the first frame synchronizing signal FS1, supplied from the first selector 370, to the timing controller 108 in response to the frame variable signal FVS of the first logic state to the timing controller 108. The second selector 376 supplies the second frame synchronizing signal FS2 supplied from the first frequency converter 372 to the timing controller 108 in response to the frame variable signal FVS of the second logic state. The second selector 376 supplies the third frame synchronizing signal FS3 supplied from the second frequency converter 374 to the timing controller 108 in response to the frame variable signal FVS of the third logic state.

Figure 15:
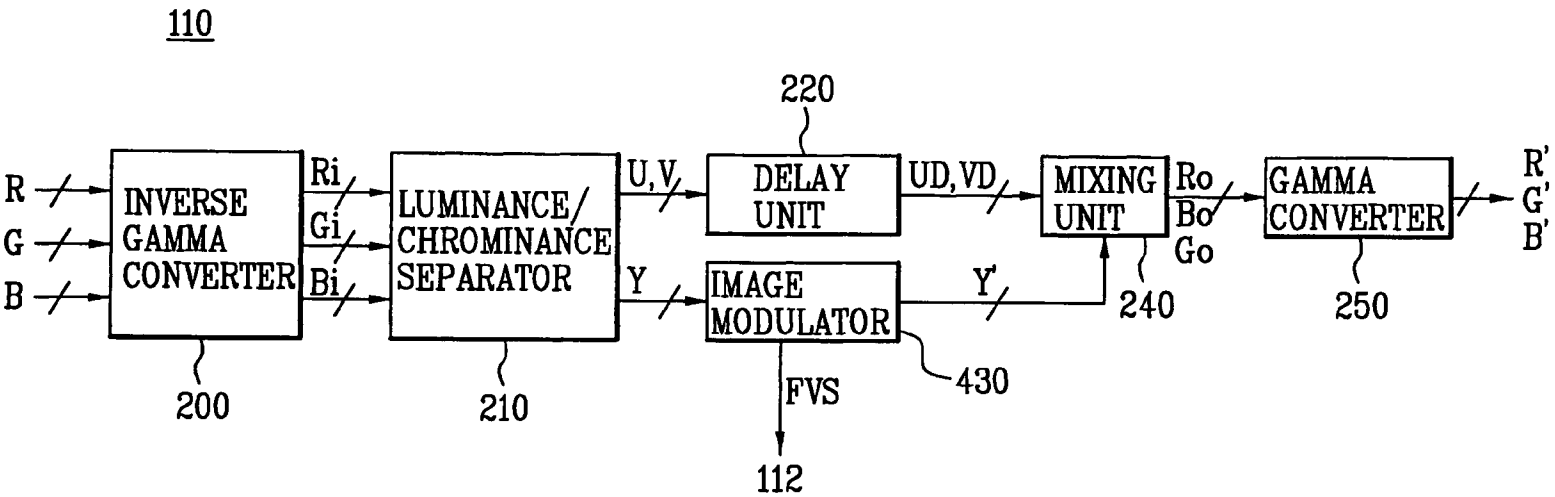
FIG. 15 is a block diagram that illustrates a data modulator shown in FIG. 6 in accordance with the second embodiment.

FIG. 15 is a block diagram that illustrates the data modulator 110 shown in FIG. 6 in accordance with the second embodiment.

Referring to FIG. 15 in connection with FIG. 6, the data modulator 110 according to the second embodiment includes an inverse gamma converter 200, a luminance/chrominance separator 210, a delay unit 220, an image modulator 430, a mixing unit 240, and a gamma converter 250.

The data modulator 110 according to the second embodiment has the same structure as that of the data modulator according to the first embodiment except for the image modulator 430.

Figure 16:
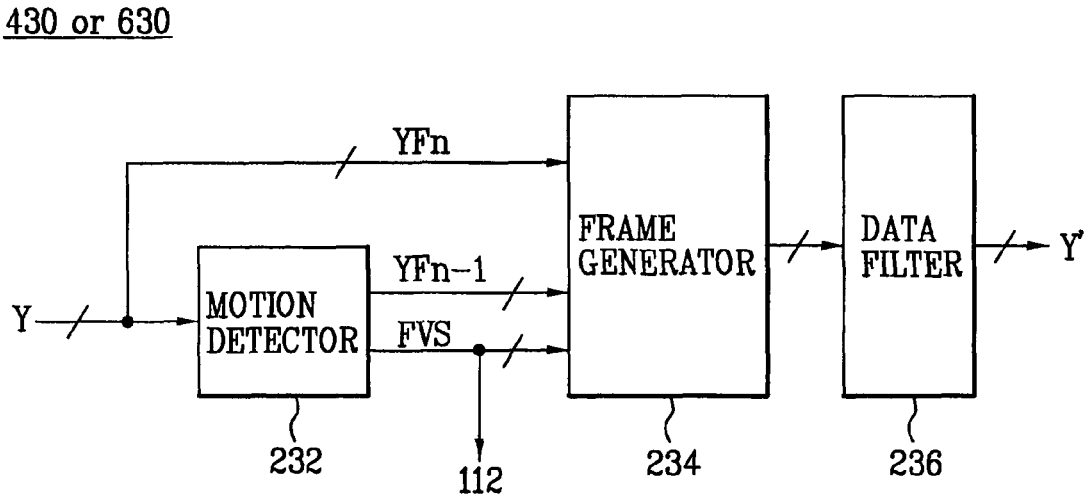
FIG. 16 is a block diagram that illustrates a data modulator shown in FIG. 15 in accordance with the second embodiment.

The image modulator 430 according to the second embodiment, as shown in FIG. 16, includes a motion detector 232, a frame generator 234, and a data filter 236.

The image modulator 430 has the same structure as that of the image modulator 230 according to the first embodiment shown in FIGS. 9 and 10 except for the data filter 236.

Figure 17:
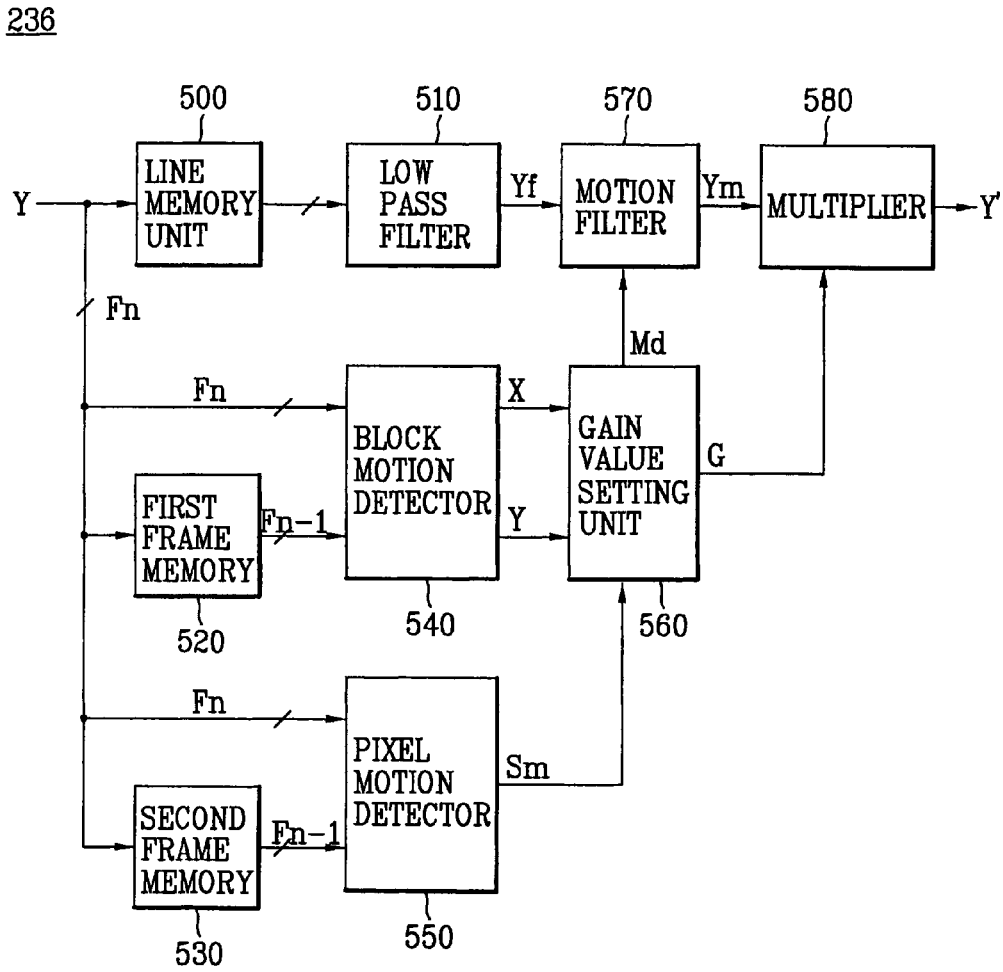
FIG. 17 is a block diagram that illustrates a data filter shown in FIG. 16.

The data filter 236, as shown in FIG. 17, includes a line memory unit 500, a low pass filter 510, first and second frame memories 520 and 530, a block motion detector 540, a pixel motion detector 550, a gain value setting unit 560, a motion filter 570, and a multiplier 580.

The line memory unit 500 stores the luminance component Y of at least three horizontal lines using at least three line memories that store the luminance component Y supplied from the frame generator 234 for each unit of one horizontal line, and supplies the luminance component Y of a block unit of i×i (i is a positive number above 3) to the low pass filter 510.

The low pass filter 510 low pass filters the luminance component Y of a block unit i×i supplied from the line memory unit 500 and supplies the low pass filtered luminance component to the motion filter 570.

The low pass filter 510 enlarges the dispersion size of Gaussian distribution for the luminance component Y of a block unit of i×i using the luminance component Y of a block unit of i×i. Accordingly, the low pass filtered luminance component Y becomes a soft image by means of the low pass filter 510.

Each of the first and second frame memories 520 and 530 stores the luminance component Y supplied from the frame generator 234 for each unit of frame.

The block motion detector 540 detects motion sizes X and Y including X-axis displacement and Y-axis displacement for motion of a block unit of i×i by comparing the luminance component Y of the current frame Fn supplied from the frame generator 234 with the luminance component Y of the previous frame Fn-1 supplied from the first frame memory 320.

The pixel motion detector 550 generates a motion signal Sm of a pixel unit by comparing the luminance component Y of the current frame Fn supplied from the frame generator 234 with the luminance component Y of the previous frame Fn-1 supplied from the first frame memory 320 for each unit of pixel, and supplies the generated motion signal Sm to the gain value setting unit 560. The motion signal Sm becomes the first logic state (high) if motion exists between the current frame Fn and the previous frame Fn-1. The motion signal Sm becomes the second logic state (low) if not so.

The gain value setting unit 560 sets a gain value G for setting motion speed using the motion sizes X and Y from the block motion detector 540 and the motion signal Sm from the pixel motion detector 550. The gain value setting unit 560 sets motion direction Md using the motion sizes X and Y from the block motion detector 540.

If the motion signal Sm is in the first logic state, the gain value setting unit 560 sets the gain value G in response to the motion sizes X and Y as expressed by the following equation (9) and supplies the set gain value to the multiplier 580. In this case, since the gain value G is determined by X-axis displacement and Y-axis displacement of motion, motion speed increases if the gain value increases.

$$G=\sqrt{X^2+Y^2} \tag{9}$$

The gain value setting unit 560 detects motion direction Md of a block unit of i×i in response to X-axis displacement and Y-axis displacement of motion if the motion signal Sm is in the first logic state and supplies the detection motion direction Md to the motion filter 570. The motion direction of a block unit of i×i is determined by any one of eight displacements of a moving image displayed by the previous frame Fn-1 and the current frame Fn, for example, the left side to the right side, upper side to the lower side, left upper corner to the right lower corner, and left lower corner to the right upper corner.

If the motion signal Sm is in the second logic state, the gain value setting unit 560 sets the gain value G at "0" and detects the motion direction Md at "0" so as to supply the resultant value to the multiplier 580.

Figure 18:
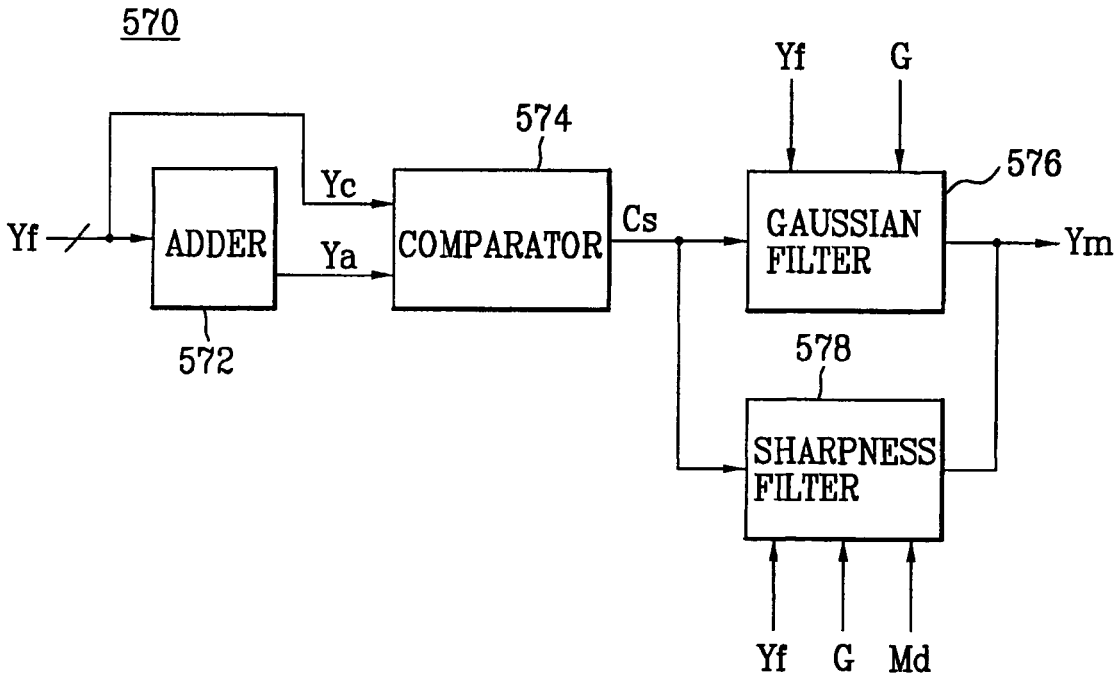
FIG. 18 is a block diagram that illustrates a motion filter shown in FIG. 17.

The motion filter 570, as shown in FIG. 18, includes an adder 572, a comparator 574, a Gaussian filter 576, and a sharpness filter 578.

The adder 572 adds a luminance component Yf of a block unit of i×i low pass filtered by the low pass filter 510 to a luminance component Yf of a peripheral area excluding a center portion, and supplies the added luminance component Ya to the comparator 574.

The comparator 574 generates a comparing signal Cs by comparing the luminance component Yc of the center portion from the luminance component Yf of a block unit of i×i low pass filtered by the low pass filter 510 with the luminance component Ya added from the adder 572, and supplies the generated comparing signal Cs to the Gaussian filter 576 and the sharpness filter 578. The comparing signal Cs becomes the first logic state (high) if the luminance component Yc of the center portion is greater than the luminance component Ya. The comparing signal Cs becomes the second logic state (low) if not so.

If the comparing signal Cs that is supplied from the comparator 574 is in the first logic state, the Gaussian filter 576 filters the luminance component Yf of a block unit of i×i low pass filtered by the low pass filter 510 in response to the gain value G supplied from the gain value setting unit 560 to obtain a value of "1" as the sum of the luminance component Yf, and supplies the resultant value to the multiplier 580. The Gaussian filter 576 smoothly filters the luminance component Yf of a block unit of i×i so as to minimize overshoot occurring in the luminance component Yf of a block unit of i×i.

If the comparing signal Cs supplied from the comparator 574 is in the second logic state, the sharpness filter 576 filters the luminance component Yf of a block unit of i×i low pass filtered by the low pass filter 510 in response to the gain value G supplied from the gain value setting unit 560 and the motion direction Md to obtain a value of "0" as the sum of the luminance component Yf, and supplies the resultant value to the multiplier 580. The sum of the luminance component Ym of a block unit of i×i filtered by the sharpness filter 578 has a value of "0" because the luminance component in the center portion has a value greater (+) than the luminance component in the peripheral area while the luminance component in the peripheral area has a value smaller (−) than the luminance component in the center portion. The sharpness filter 578 sharply filters the luminance component Yf of a block unit of i×i in response to the gain value G and the motion direction Md so as to generate undershoot in the luminance component Yf of a block unit of i×i.

The motion filter 570 filters the luminance component Yf of a block unit of i×i low pass filtered by the low pass filter 510 in response to the motion speed of the block motion detector 540 so as to generate undershoot in a boundary between a still image and a moving image and to minimize overshoot.

The multiplier 580 supplies the modulated luminance component Y' to the mixing unit 240 by multiplying the luminance component Ym filtered from the motion filter 570 and the gain value G supplied from the gain value setting unit 560. The size of the undershoot occurs in the boundary between the still image and the moving image is controlled by the gain value G.

Figure 19A:
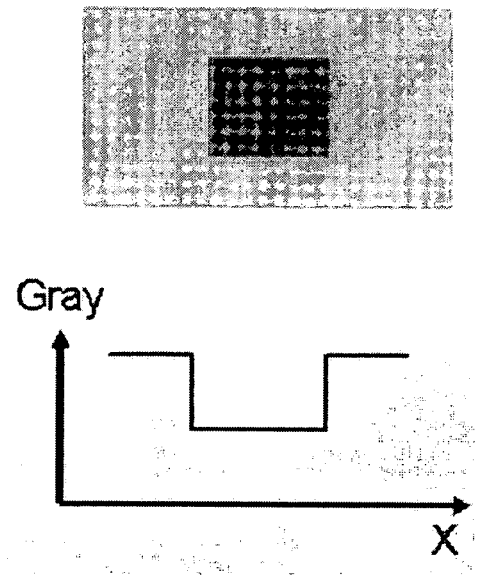
FIG. 19A illustrates luminance components of modulated data supplied to a data filter shown in FIG. 17.
Figure 19B:
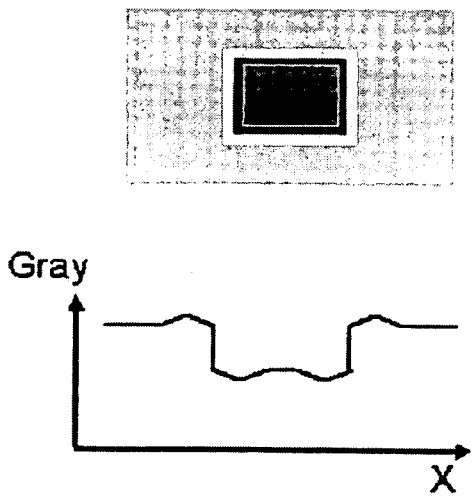
FIG. 19B illustrates overshoot and undershoot occurring if luminance components of modulated data are sharply filtered.

If the luminance component Y of the modulated data is sharply filtered, the image of the modulated data shown in FIG. 19A generates undershoot (black portion) and overshoot (white portion) in every boundary between the still image and the moving image as shown in FIG. 19B. Motion blurring occurs in the image of the modulated data due to overshoot occurring in every boundary between the still image and the moving image. In other words, overshoot causes motion blurring using twinkling effect susceptible to the eyes of a human being.

Figure 19C:
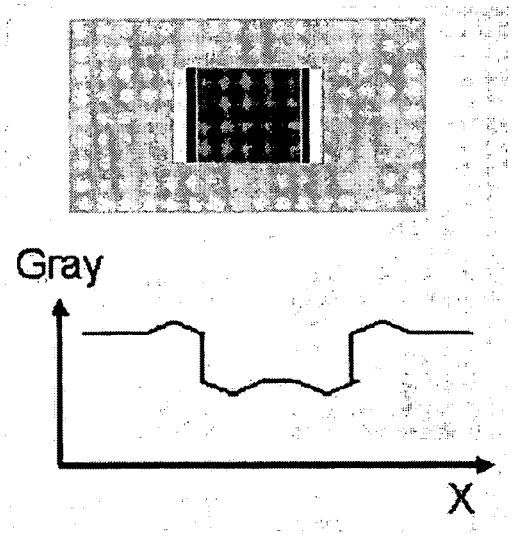
FIG. 19C illustrates overshoot and undershoot that occur if only a moving image is sharply filtered from luminance components of modulated data.
Figure 19D:
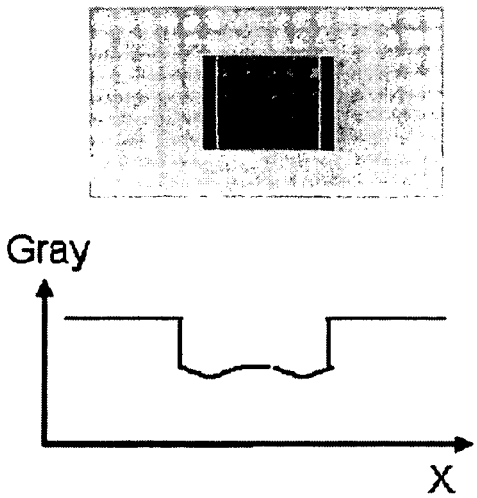
FIG. 19D illustrates undershoot that occurs in a boundary between a still image and a moving image if only the moving image is sharply filtered from luminance components of modulated data.
Figure 20A:
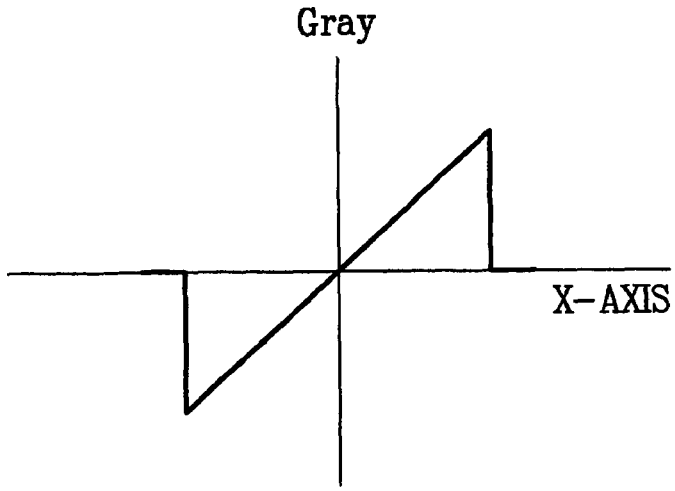
FIG. 20A is a waveform that illustrates luminance components of a boundary between a still image and a moving image in luminance components of modulated data.
Figure 20B:
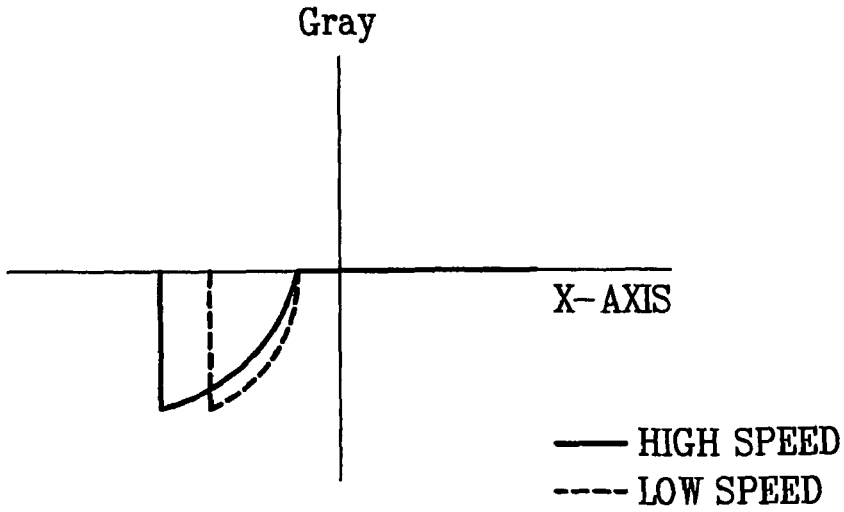
FIG. 20B is a waveform that illustrates the size of undershot occurring in a boundary between a still image and a moving image in accordance with a gain value obtained by motion speed from luminance components of modulated data.

The data filter 236 modulates the luminance component Y to generate clear black lines in the boundaries between the still image and the moving image using only undershoot except for overshoot susceptible to the eyes of the human being. For example, the data filter 236 modulates the luminance component Y of the modulated data, of which the moving image is sharply filtered as shown in FIG. 19C, so as to generate undershoot only in the boundaries between the still image and the moving image as shown in FIG. 19D. As shown in FIG. 20A, the size of undershoot is determined by the motion speed of the moving image as shown in FIG. 20B in the boundaries between the still image and the moving image. In other words, if the moving image is moving at a motion speed above three pixels for each unit of frame, the size of undershoot is increased relatively. If the moving image is moving at a motion speed below three pixels for each unit of frame, the size of undershoot becomes reduced relatively.

According to the second embodiment, the motion of the moving image is detected from the original image in which the number of frames is varied by the frame variable signal FVS, and the luminance component Y is modulated by sharpness filtering in response to the gain value G caused by the detected motion speed and direction Md so as to generate only undershoot in the boundaries between the still image and the moving image. As a result, it is possible to naturally separate the still image from the moving image and obtain a clear moving image, whereby a three-dimensional moving image can be obtained by accommodation effect.

Figure 21:
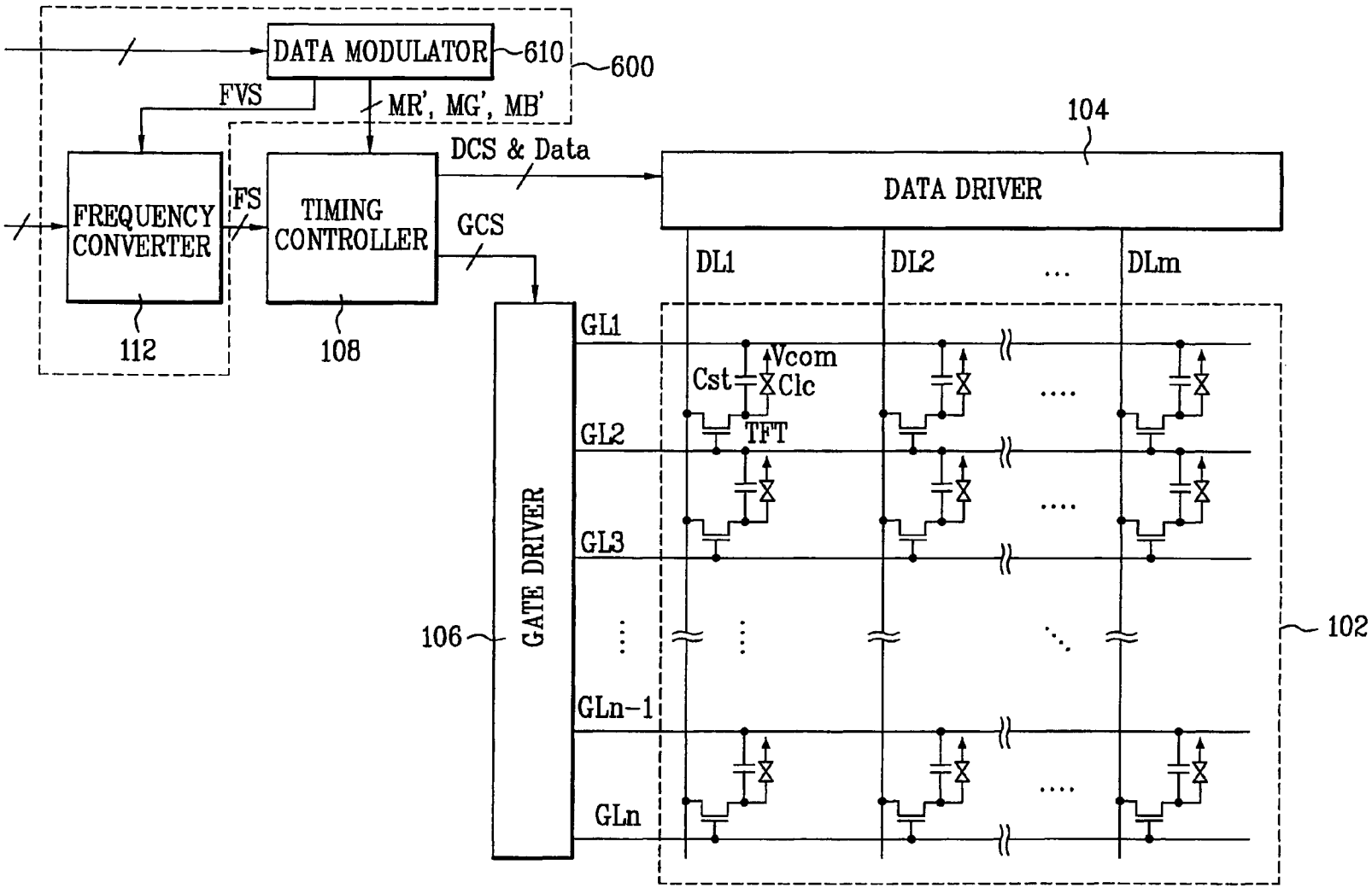
FIG. 21 illustrates an apparatus for driving an LCD device according to the second embodiment.

FIG. 21 illustrates an apparatus for driving an LCD device according to the third embodiment.

Referring to FIG. 21, the apparatus that drives an LCD device according to the third embodiment includes an image display unit 102 that includes liquid crystal cells formed in each region defined by first to n-th gate lines GL1 to GLn and first to m-th data lines DL1 to DLm. A data driver 104 supplies analog video signals to the data lines DL1 to DLm. A gate driver 106 supplies scan signals to the gate lines GL1 to GLn. A frame varying unit 600 detects a motion vector from externally input source data RGB, generates first modulated data R'G'B' and a frame variable signal FVS for varying the number of frames of an image displayed in the image display unit 102, in response to the motion vector, and modulates the generated first modulated data R'G'B' to second modulated data MR', MG' and MB' for accelerating the response speed of the liquid crystal. A timing controller 108 aligns the second modulated data MR', MG', and MB' from the frame varying unit 600 to supply the aligned data to the data driver 104, generates data control signals DCS that drive the data driver 104, and generates gate control signals GCS that drive the gate driver 106.

The apparatus for driving an LCD device according to the third embodiment has the same structure as that of the apparatus according to the first embodiment excluding the frame varying unit 600 and the timing controller 108.

The frame varying unit 600, according to the third embodiment, includes a data modulator 610 and a frequency converter 112.

The data modulator 610 detects the motion vector from the luminance component of the externally input source data RGB and generates the frame variable signal FVS in response to the detected motion vector. The data modulator 610 generates the first modulated data R'G'B' by modulating the luminance component of the source data RGB to obtain the number of frames corresponding to the frame variable signal FVS. The data modulator 610 modulates the first modulated data R'G'B' to the second modulated data MR', MG', and MB' to accelerate the response speed of the liquid crystal and supplies the second modulated data to the timing controller 108.

The frequency converter 112 generates a frame synchronizing signal FS by varying an externally input reference frame synchronizing signal FS1 in response to the frame variable signal FVS from the data modulator 610, and supplies the generated frame synchronizing signal FS to the timing controller 108. Since the frequency converter 112 is constructed in the same manner as shown in FIG. 14, its description is the same as the description of FIG. 14.

The frame varying unit 600, which includes the data modulator 610 and the frequency converter 112, may be provided inside the timing controller 108.

The timing controller 108 aligns the second modulated data MR', MG', and MB' supplied from the data modulator 610 to a data signal Data that drives the image display unit 102, and supplies the aligned data signal Data to the data driver 104.

The timing controller 108 drives the data driver 104 by generating the data control signals DCS, which include, for example, a source start pulse SSP, a source shift clock SSC, a polarity signal POL, and a source output enable signal SOE, using the frame synchronizing signal FS input from the frequency converter 112. In this case, the frame synchronizing signal FS may be a main clock MCLK, a data enable signal DE, and horizontal and vertical synchronizing signals Hsync and Vsync.

The timing controller 108 drives the gate driver 106 by generating the gate control signals GCS, which include a gate start pulse GSP, a gate shift clock GSC, and a gate output enable signal GOE, using the frame synchronizing signal FS input from the frequency converter 112.

Figure 22:
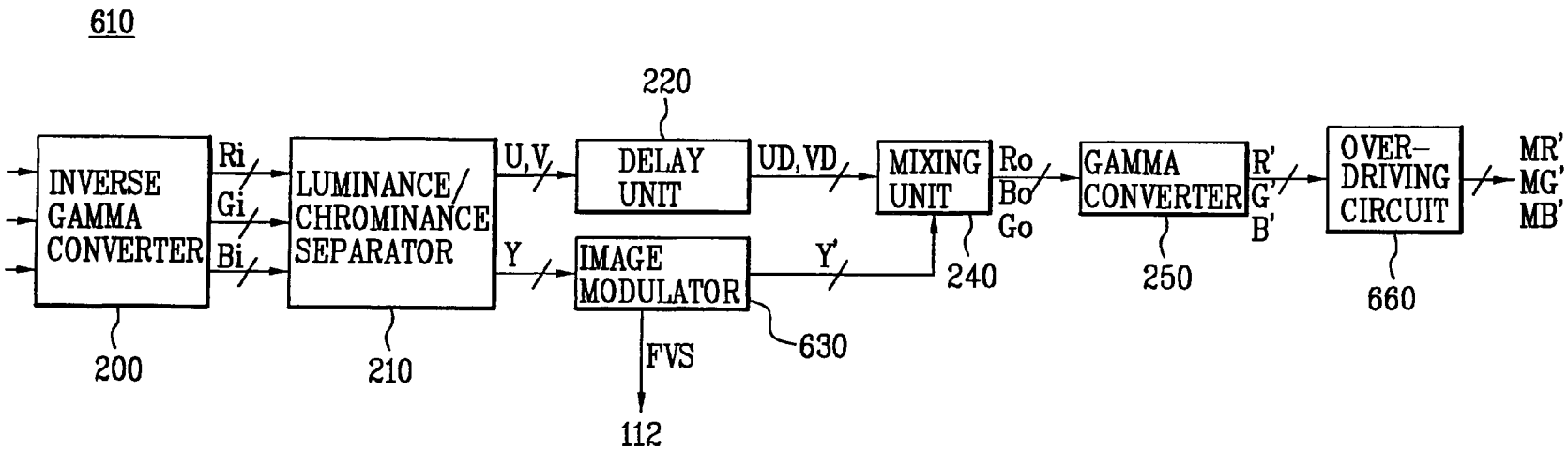
FIG. 22 is a block diagram illustrating a data modulator shown in FIG. 21 in accordance with the third embodiment.

The data modulator 610 according to the third embodiment, as shown in FIG. 22, includes an inverse gamma converter 200, a luminance/chrominance separator 210, a delay unit 220, an image modulator 630, a mixing unit 240, a gamma converter 250, and an over-driving circuit 660.

The data modulator 610 according to the third embodiment has the same structure as that of the data modulator according to the first embodiment except for the image modulator 630 and the over-driving circuit 660.

The image modulator 630 according to the third embodiment is comprised of the image modulator 230 according to the first embodiment as shown in FIGS. 9 and 10, or the image modulator 430 according to the second embodiment as shown in FIGS. 16 and 17. Therefore, the description of the image modulator 630 according to the third embodiment is the same as the description of the image modulators 230 and 430 according to the first and second embodiments.

Figure 23:
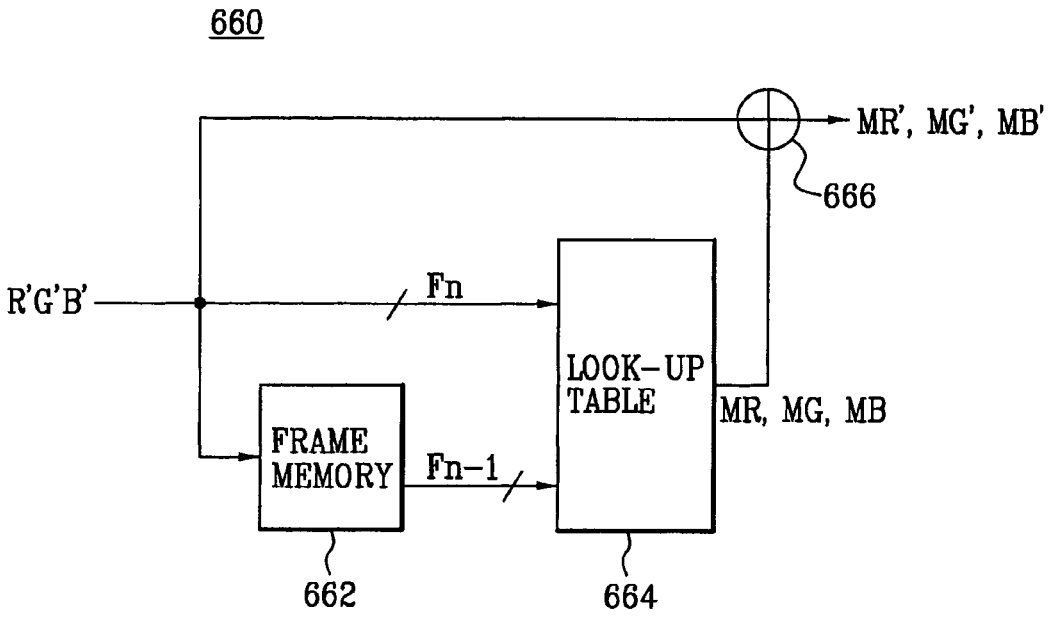
FIG. 23 is a block diagram illustrating a over-driving apparatus shown in FIG. 22

The over-driving circuit 660, as shown in FIG. 23, includes a frame memory 662 that stores the first modulated data R'G'B' supplied from the gamma converter 250, a look-up table 664 that generates over-driving data MR, MG and MB that accelerates the response speed of the liquid crystal by comparing the first modulated data R'G'B' of the current frame Fn supplied from the gamma converter 250 with the first modulated data R'G'B' of the previous frame Fn-1 from the frame memory 662, and a mixing unit 666 that mixes the over-driving data MR, MG and MB from the look-up table 664 with the first modulated data R'G'B' of the current frame Fn and supplies the mixed data to the timing controller 108.

The look-up table 664 lists the over-driving data MR, MG and MB that converts a voltage of the first modulated data R'G'B' of the current frame Fn into a higher voltage to obtain the fast response speed of the liquid crystal, thereby adapting to a gray level value of an image moving at the fast speed.

The mixing unit 666 generates the second modulated data MR', MG' and MB' by mixing the first modulated data R'G'B' of the current frame Fn with the over-driving data MR, and supplies the generated second modulated data MR', MG' and MB' to the timing controller 108.

In the apparatus for driving an LCD device according to the third embodiment, as the number of frames is varied by the frame variable signal FVS, the supplied data are modulated to accelerate the response speed of the liquid crystal, whereby motion blurring of the moving image can be removed.

The embodiments described above have the following, as well as other advantages. The frame variable signal is generated by the motion of the image, and the number of frames of the image displayed in the image display unit is varied by the frame variable signal, so that motion blurring of the moving image can be removed.

The image is modulated by filtering in response to the motion direction and speed of the frame image varied by the frame variable signal so as to generate undershoot only in the boundaries between the still image and the moving image. It is possible to naturally separate the still image from the moving image and obtain a clear moving image, whereby a three-dimensional moving image can be obtained by accommodation effect.

It is possible to remove motion blurring using algorithm without changing panel design and hardware and also to obtain a clearer image and a three-dimensional still image having no noise.

It will be apparent to those skilled in the art that various modifications and variations can be made without departing from the spirit or scope of the invention. Thus, it is intended that the present invention cover the modifications and variations of this invention provided they come within the scope of the appended claims and their equivalents.

What is claimed is:

1. An apparatus for driving an LCD device, comprising:

an image display unit that displays an image;

a data driver that supplies video signals to the image display unit;

a gate driver that supplies scan signals to the image display unit;

a frame varying unit that detects a motion vector from externally input source data and that generates modulated data and a frame variable signal that varies the number of frames of the image displayed in the image display unit in response to the motion vector; and a timing controller that aligns the modulated data to supply the aligned data to the data driver, generates data control signals that drive the data driver, and generates gate control signals that drive the gate driver, wherein the frame varying unit includes:

a data modulator that generates the frame variable signal by detecting the motion vector from a luminance component of the source data, generates the modulated data to obtain the number of frames corresponding to the frame variable signal, and supplies the generated frame variable signal and the generated modulated data to the timing controller; and a frequency converter that generates a frame synchronizing signal that corresponds to the number of frames by varying an externally input reference frame synchronizing signal in response to the frame variable signal, and supplies the generated frame synchronizing signal to the timing controller, wherein the data modulator includes:

an inverse gamma converter that performs inverse gamma correction for the source data for each unit of frame to generate first data including first red, green and blue (hereafter, R/G/B) signals;

a luminance/chrominance separator that separates the first data into a luminance component and chrominance components;

an image modulator that generates the frame variable signal by detecting the motion vector using a luminance component of a previous frame and a luminance component of a current frame supplied from the luminance/chrominance separator, and generates a modulated luminance component as the modulated data in response to the frame variable signal;

a delay unit that delays the chrominance components of at least one frame unit while the image modulator generates the modulated luminance component and then that output the delayed chrominance components to synchronize with the modulated luminance component;

a mixing unit that mixes the modulated luminance component that is supplied from the image modulator with the delayed chrominance components supplied from the delay unit to generate second data including second R/G/B signals; and a gamma converter that performs gamma correction for the second data from the mixing unit to generate the modulated data, wherein the image modulator includes:

a motion detector that detects the motion vector and then that detects the frame variable signal using the motion vector; and a frame generator that generates the modulated luminance component in response to the frame variable signal, wherein the motion detector includes:

a frame memory that stores the luminance component supplied from the luminance/chrominance separator for each unit of frame;

a motion vector generator that generates the motion vector using the luminance component of the current frame supplied from the luminance/chrominance separator and the luminance component of the previous frame supplied from the frame memory; and a comparator that generates the frame variable signal by comparing the motion vector with first and second reference values set differently from each other, wherein frame generator generates the modulated luminance component that includes an insertion frame using the luminance components of the previous and current frames, excluding the chrominance components from the luminance/chrominance separator.

2. The apparatus as in claim 1, wherein the comparator generates a frame variable signal of a first logic state if the motion vector is smaller than the first reference value, generates a frame variable signal of a second logic state if the motion vector is between the first and second reference values, and generates a frame variable signal of a third logic state if the motion vector is greater than the second reference value.

3. The apparatus as in claim 2, wherein the frame generator generates the luminance component of the modulated data to have any one of frame frequencies of 60 Hz, 90 Hz and 120 Hz in response to the frame variable signal.

4. The apparatus as in claim 3, wherein the frame generator generates the luminance component of the modulated data having a frame frequency of 60 Hz by bypassing the luminance component of the current frame in response to the frame variable signal of the first logic state, generates the luminance component of the modulated data having a frame frequency of 90 Hz by using the luminance component of the current frame and the luminance component of the previous frame in response to the frame variable signal of the second logic state, and generates the luminance component of the modulated data having a frame frequency of 120 Hz by using the luminance component of the current frame and the luminance component of the previous frame in response to the frame variable signal of the third logic state.

5. The apparatus as in claim 2, wherein the frequency converter includes:

a first selector that selects the reference frame synchronizing signal as a first frame synchronizing signal in response to the frame variable signals of the first to third logic states;

a first frequency converter that generates a second frame synchronizing signal by converting a frequency of the first frame synchronizing signal output from the first selector in response to the frame variable signal of the second logic state;

a second frequency converter that generates a third frame synchronizing signal by converting the frequency of the first frame synchronizing signal output from the first selector in response to the frame variable signal of the third logic state; and a second selector that selects the first to third frame synchronizing signals as the frame synchronizing signal in response to the frame variable signals of the first to third logic states and supplies the selected signals to the timing controller.

6. The apparatus as in claim 5, wherein the reference frame synchronizing signal and the first frame synchronizing signal have a frame frequency of 60 Hz, the second frame synchronizing signal has a frame frequency of 90 Hz, and the third frame synchronizing signal has a frame frequency of 120 Hz.

7. The apparatus as in claim 6, wherein the second selector supplies the first frame synchronizing signal to the timing controller in response to the frame variable signal of the first logic state, supplies the second frame synchronizing signal to the timing controller in response to the frame variable signal of the second logic state, and supplies the third frame synchronizing signal to the timing controller in response to the frame variable signal of the third logic state.

8. A method for driving an LCD device having an image display unit displaying an image, the method comprising:

detecting a motion vector from externally input source data of the image; and generating modulated data and a frame variable signal that varies the number of frames of the image displayed in the image display unit in response to the motion vector;

generating the modulated data to obtain the number of frames corresponding to the frame variable signal;

generating a frame synchronizing signal by varying an externally input reference frame synchronizing signal in response to the frame variable signal to correspond to the number of frames;

generating data and gate control signals using the frame synchronizing signal;

supplying scan signals to the image display unit using the gate control signals; and converting the modulated data into analog video signals using the data control signals and supplying the analog video signals to the image display unit to synchronize with the scan signals, wherein the act of generating the modulated data includes:

performing inverse gamma correction for the source data for each frame to generate first data including first R/G/B signals;

separating the first data into a luminance component and chrominance components;

generating the frame variable signal by detecting the motion vector using a luminance component of a previous frame and a luminance component of a current frame separated from the first data, and generating a modulated luminance component as the modulated data in response to the frame variable signal;

delaying the chrominance components of at least one frame unit while generating the modulated luminance component and then outputting the delayed chrominance components to synchronize with the modulated luminance component;

mixing the modulated luminance component with the delayed chrominance components to generate second data including second R/G/B signals; and performing gamma correction for the second data to generate the modulated data, wherein the act of generating the frame variable signal includes:

storing the luminance component separated from the first data for each unit of frame using a frame memory;

generating the motion vector using the luminance component of the current frame separated from the first data and the luminance component of the previous frame supplied from the frame memory; and generating the frame variable signal by comparing the motion vector with first and second reference values set differently from each other using a comparator, wherein the modulated luminance component includes an insertion frame using the luminance components of the previous and current frames, excluding the chrominance components.

9. The method as in claim 8, wherein the act of generating the frame variable signal using the comparator includes generating a frame variable signal of a first logic state if the motion vector is smaller than the first reference value, generating a frame variable signal of a second logic state if the motion vector is between the first and second reference values, and generating a frame variable signal of a third logic state if the motion vector is greater than the second reference value.

10. The method as in claim 9, wherein the act of generating the luminance component of the modulated data includes generating the luminance component of the modulated data having a frame frequency of 60 Hz by bypassing the luminance component of the current frame in response to the frame variable signal of the first logic state, generating the luminance component of the modulated data having a frame frequency of 90 Hz by using the luminance component of the current frame and the luminance component of the previous frame in response to the frame variable signal of the second logic state, and generating the luminance component of the modulated data having a frame frequency of 120 Hz by using the luminance component of the current frame and the luminance component of the previous frame in response to the frame variable signal of the third logic state.

11. The method as in claim 9, wherein the act of generating the frame synchronizing signal includes:

selecting the reference frame synchronizing signal as a first frame synchronizing signal in response to the frame variable signals of the first to third logic states;

generating a second frame synchronizing signal by converting a frequency of the first frame synchronizing signal in response to the frame variable signal of the second logic state;

generating a third frame synchronizing signal by converting the frequency of the first frame synchronizing signal in response to the frame variable signal of the third logic state; and selecting the first to third frame synchronizing signals as the frame synchronizing signal in response to the frame variable signals of the first to third logic states.

12. The method as in claim 11, wherein the reference frame synchronizing signal and the first frame synchronizing signal have a frame frequency of 60 Hz, the second frame synchronizing signal has a frame frequency of 90 Hz, and the third frame synchronizing signal has a frame frequency of 120 Hz.

13. The method as in claim 12, wherein the act of selecting the frame synchronizing signal includes selecting the first frame synchronizing signal in response to the frame variable signal of the first logic state, selecting the second frame synchronizing signal in response to the frame variable signal of the second logic state, and selecting the third frame synchronizing signal in response to the frame variable signal of the third logic state.

* * * * *